US011971239B2

(12) United States Patent
Davis et al.

(10) Patent No.: US 11,971,239 B2
(45) Date of Patent: Apr. 30, 2024

(54) VARIABLE VELOCITY BARREL ASSEMBLY

(71) Applicant: Gel Blaster, Inc., Austin, TX (US)

(72) Inventors: Eric Davis, Austin, TX (US); Colin Guinn, Austin, TX (US); Robert Kovacs, Austin, TX (US)

(73) Assignee: GEL BLASTER, INC., Austin, TX (US)

( * ) Notice: Subject to any disclaimer, the term of this patent is extended or adjusted under 35 U.S.C. 154(b) by 0 days.

(21) Appl. No.: 18/233,021

(22) Filed: Aug. 11, 2023

(65) Prior Publication Data

US 2023/0384054 A1 Nov. 30, 2023

Related U.S. Application Data

(63) Continuation of application No. 17/952,160, filed on Sep. 23, 2022, now Pat. No. 11,725,901.

(60) Provisional application No. 63/248,003, filed on Sep. 24, 2021.

(51) Int. Cl.

| | |
|---|---|
| ***F41A 21/00*** | (2006.01) |
| ***F41B 11/723*** | (2013.01) |
| ***F41B 11/724*** | (2013.01) |
| ***F41B 11/73*** | (2013.01) |

(52) U.S. Cl.

CPC ..... *F41B 11/723* (2013.01); *F41B 11/724* (2013.01); *F41B 11/73* (2013.01)

(58) Field of Classification Search

CPC ..... F41B 11/00; F41B 11/52; F41B 11/723; F41B 11/724; F41B 11/73; F41B 11/70; F41B 11/643; F41B 4/00; F41B 7/08; F41A 21/32; F41A 21/38; F41A 21/48; F41A 21/00; F41A 21/36; F41A 9/02

USPC ..... 89/14.3; 42/79; 124/83, 84, 71

See application file for complete search history.

(56) References Cited

U.S. PATENT DOCUMENTS

| | | | |
|---|---|---|---|
| 1,598,360 | A | 8/1926 | Pavek |
| 5,425,298 | A | 6/1995 | Coburn |
| 5,814,757 | A | 9/1998 | Buss |
| 6,820,530 | B2 | 11/2004 | Vais |
| 10,118,696 | B1 | 11/2018 | Hoffberg |
| 11,125,529 | B2 | 9/2021 | Yoon |
| 2003/0182838 | A1 | 10/2003 | Kessler |
| 2005/0183712 | A1 | 8/2005 | Goepfert |
| 2007/0017498 | A1 | 1/2007 | Finstad |
| 2021/0102769 | A1 | 4/2021 | DeRoche |

OTHER PUBLICATIONS

International Search Report and Written Opinion issued in PCT/US22/44622.

*Primary Examiner* — Michael D David

(74) *Attorney, Agent, or Firm* — Jeffer Mangels; Butler & Mitchell LLP; Brennan C. Swain, Esq.

(57) ABSTRACT

A blaster for shooting projectiles that includes a housing that defines a housing interior, and a variable velocity barrel assembly positioned in the housing interior. The variable velocity barrel assembly includes a barrel that defines a barrel axis and a barrel interior. The barrel includes an exit opening at a distal end thereof. At least a first opening communicates the barrel interior with an exterior of the barrel. The first opening is defined through a side wall of the barrel. A slider member that includes a cylindrical portion that surrounds the barrel is movable axially along the barrel between a maximum velocity position where the cylindrical portion covers the first opening and a minimum velocity position where the slider member does not cover the first opening.

20 Claims, 11 Drawing Sheets

VARIABLE VELOCITY BARREL ASSEMBLY

CROSS-REFERENCE TO RELATED APPLICATIONS

This application is a continuation of U.S. patent application Ser. No. 17/952,160, filed Sep. 23, 2022, which claims the benefit of U.S. Provisional Application No. 63/248,003, filed on Sep. 24, 2021, the entireties of which are incorporated by reference herein.

FIELD OF THE INVENTION

The present invention relates to a blaster that shoots projectiles, and more particularly to a blaster that includes a variable velocity barrel assembly.

BACKGROUND OF THE INVENTION

Blasters that shoot projectiles, such as gel based balls, paint balls and the like can be utilized by people of all ages. However, the projectiles can hurt or cause pain when they strike a person. For example, younger children may not want to be hit by a gel based ball that causes pain. Accordingly, a way to slow or vary the velocity of the projectiles is needed.

The background description disclosed anywhere in this patent application includes information that may be useful in understanding the present invention. It is not an admission that any of the information provided herein is prior art or relevant to the presently claimed invention, or that any publication specifically or implicitly referenced is prior art.

SUMMARY OF THE PREFERRED EMBODIMENTS

In accordance with a first aspect of the present invention, there is provided a blaster for shooting projectiles that includes a housing that defines a housing interior, and a variable velocity barrel assembly positioned in the housing interior. The variable velocity barrel assembly includes a barrel that defines a barrel axis and a barrel interior. The barrel includes an exit opening at a distal end thereof. At least a first opening communicates the barrel interior with an exterior of the barrel. The first opening is defined through a side wall of the barrel. A slider member that includes a cylindrical portion that surrounds the barrel is movable axially along the barrel between a maximum velocity position where the cylindrical portion covers the first opening and a minimum velocity position where the slider member does not cover the first opening.

The present invention includes a pneumatic mechanical subassembly that is configured to be used with a blaster that fires spherical or other projectiles, (exemplary blasters include the Surge 1.5 and GB2011 1.0, which fire gel based balls referred to commercially as Gellets and are sold by GEL BLASTER®) and may be referred to herein as a variable velocity barrel assembly. The variable velocity barrel assembly allows a user to select their desired projectile velocity by manually manipulating or moving a slider member forwards and backwards to increase or decrease velocity. The system or assembly works by exposing or covering side vents or openings in the barrel, thereby proportionally decreasing or maintaining venting blast pressure behind each projectile as it exits the chamber, to affect vacuum-formed drag behind each projectile.

For example, as a result of the movement of the slider member, the variable velocity barrel assembly or vented release system can provide a velocity of the fired projectile in a range between 85 ft/sec (where a user will barely feel the projectile) and 250 ft/sec (where the projectile may cause some slight pain). Between <90 ft/sec and 175 ft/sec is another possible range provided by the various openings. Any velocity or speed within these ranges is within the scope of the present invention. In a preferred embodiment, the barrel includes openings on both sides thereof and includes between one and four sets or pairs of openings (between one and up to twenty pairs of openings is within the scope of the present invention). Openings on only one side (or the top or bottom) of the barrel is also within the scope of the invention.

The invention, together with additional features and advantages thereof, may be best understood by reference to the following description.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
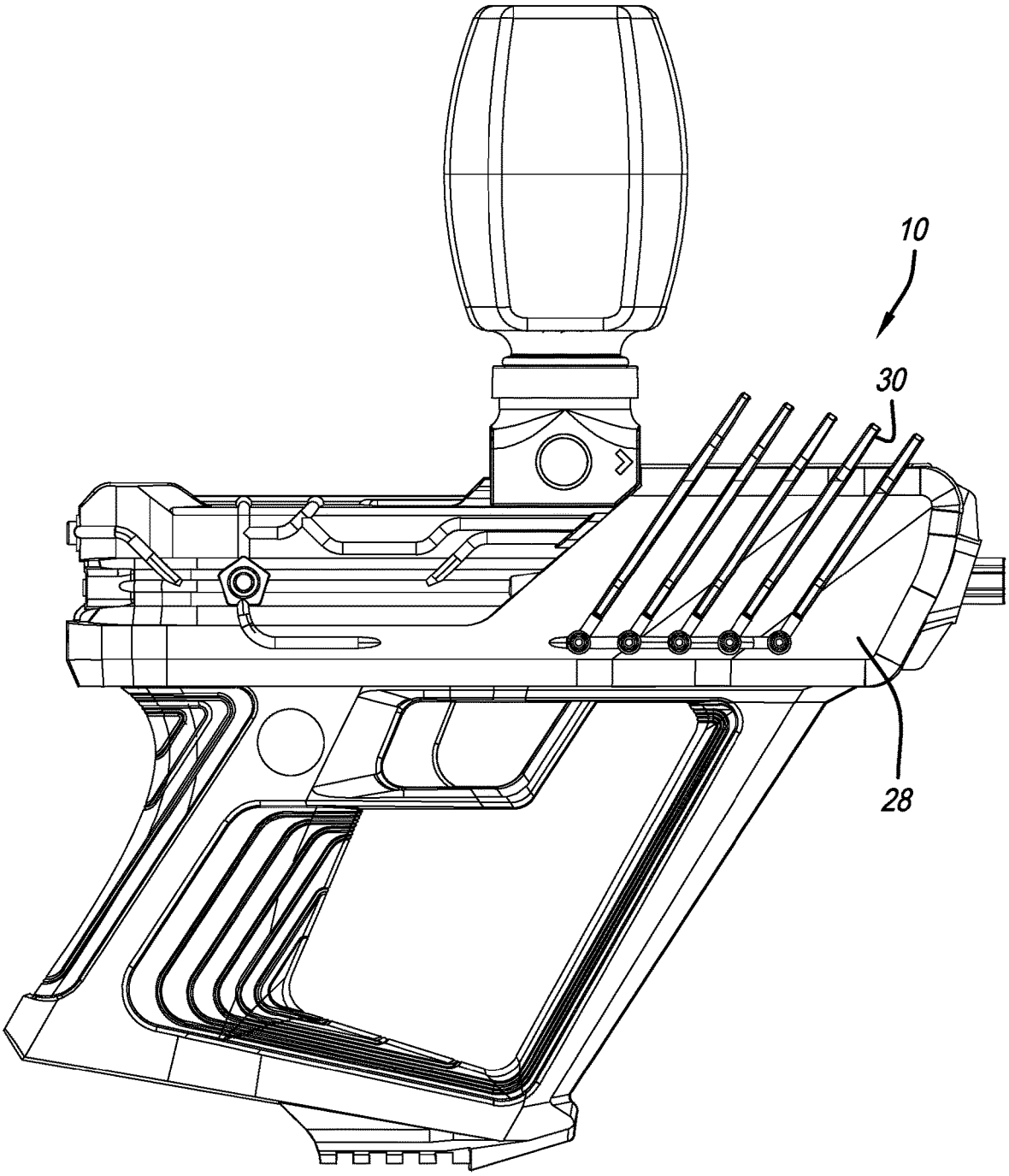
FIG. 1 is a side elevational view of a first blaster that includes a variable velocity barrel assembly in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. If a component is not shown in a drawing then this provides support for a negative limitation in the claims stating that that component is "not" present. However, the above statement is not limiting and in another embodiment, the missing component can be included in a claimed embodiment.

Reference in this specification to "one embodiment," "an embodiment," "a preferred embodiment" or any other phrase mentioning the word "embodiment" means that a particular feature, structure, or characteristic described in connection with the embodiment is included in at least one embodiment of the-disclosure and also means that any particular feature, structure, or characteristic described in connection with one embodiment can be included in any embodiment or can be omitted or excluded from any embodiment. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others and may be omitted from any embodiment. Furthermore, any particular feature, structure, or characteristic described herein may be optional. Similarly, various requirements are described which may be requirements for some embodiments but not other embodiments. Where appropriate any of the features discussed herein in relation to one aspect or embodiment of the invention may be applied to another aspect or embodiment of the invention. Similarly, where appropriate any of the features discussed herein in relation to one aspect or embodiment of the invention may be optional with respect to and/or omitted from that aspect or embodiment of the invention or any other aspect or embodiment of the invention discussed or disclosed herein.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Figure 6:
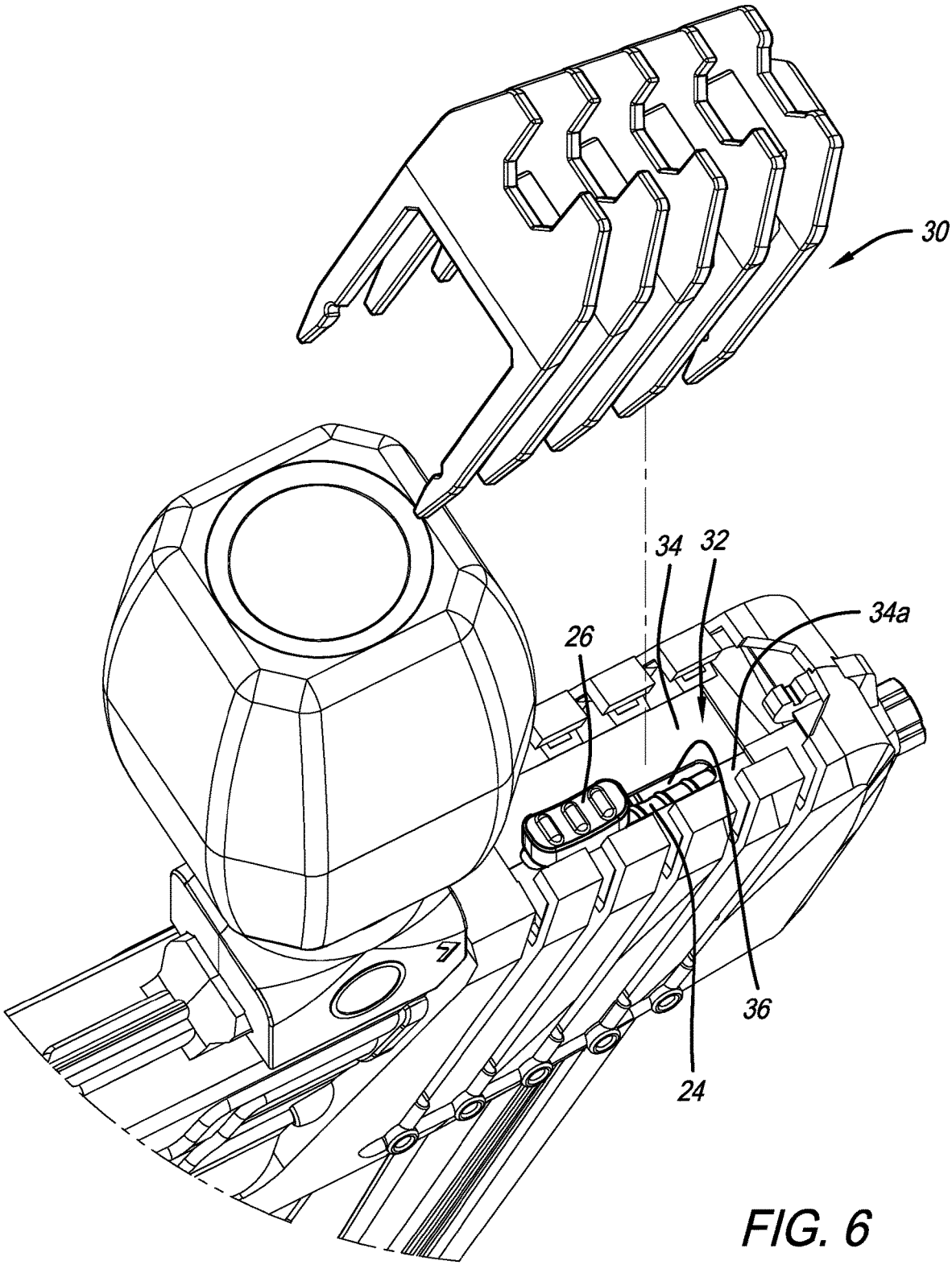
FIG. 6 is a perspective view of a portion of the blaster of FIG. 1 with the removable portion exploded therefrom.
Figure 7:
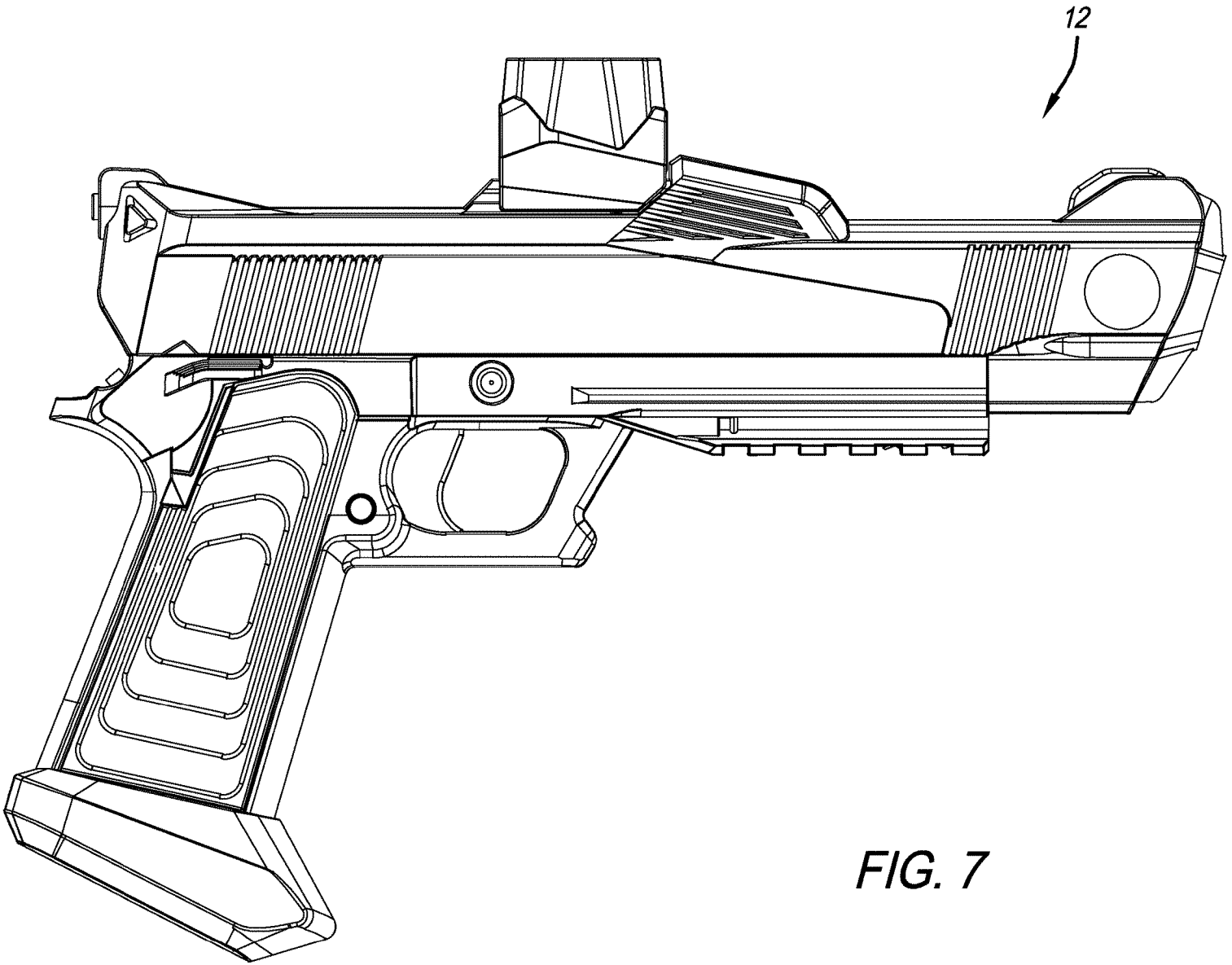
FIG. 7 is a side elevational view of a second blaster that includes a variable velocity barrel assembly in accordance with a preferred embodiment of the present invention.

The present invention is a variable velocity barrel assembly that is configured to be used with a blaster that fires spherical or other projectiles. In a preferred embodiment, as shown in FIGS. 1-11, the variable velocity barrel assembly 14 can be used with different types of projectile blasters, such as the exemplary first blaster 10, shown in FIG. 1, and the exemplary second blaster 12, as shown in FIG. 7. It will be appreciated that the variable velocity barrel assembly can be used with other projectile firing blasters or guns, such as those that fire, paintballs, foam projectiles and the like.

Figure 2:
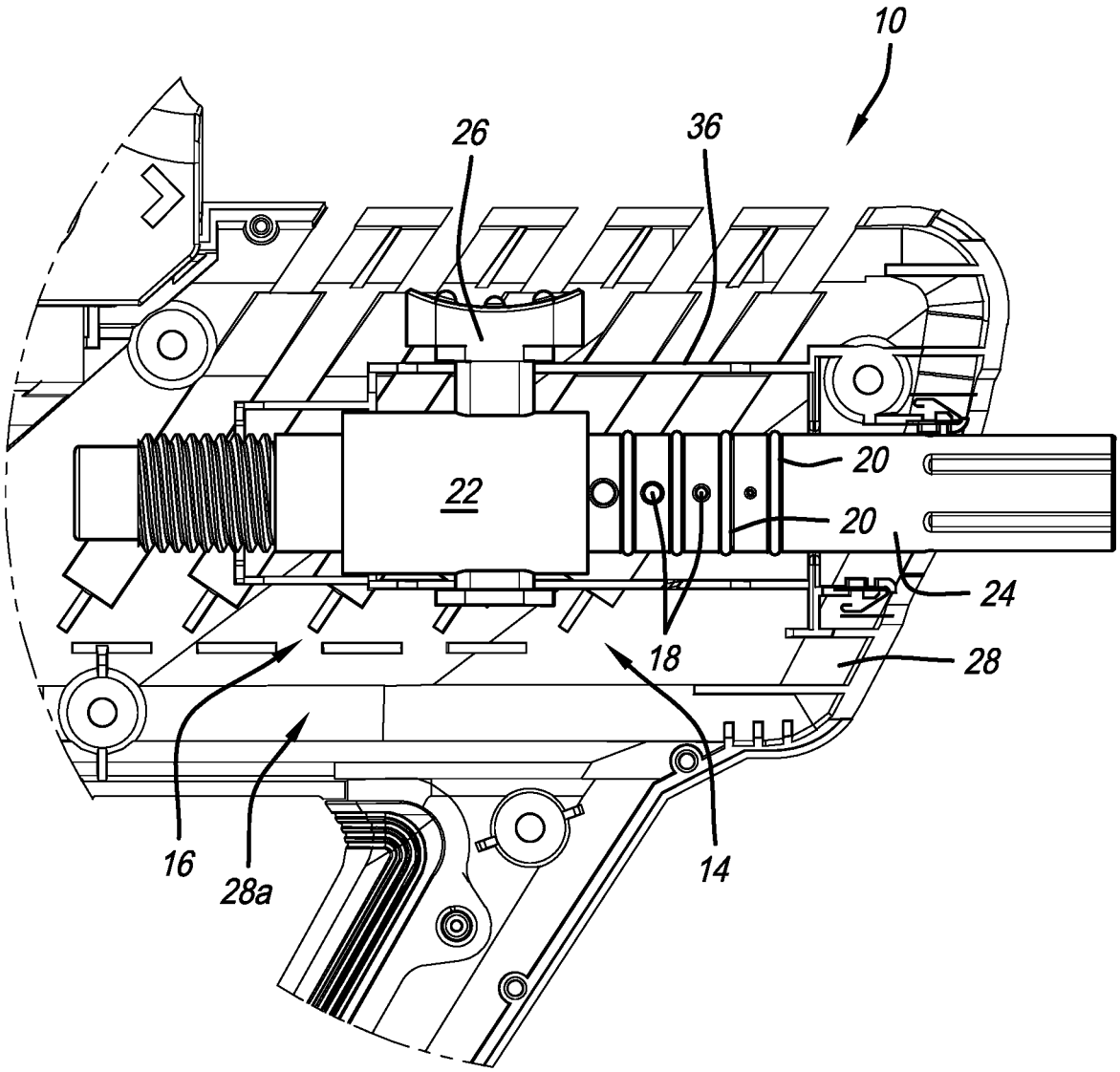
FIG. 2 is a side elevational view of the blaster of FIG. 1 with a portion of the housing removed.
Figure 3:
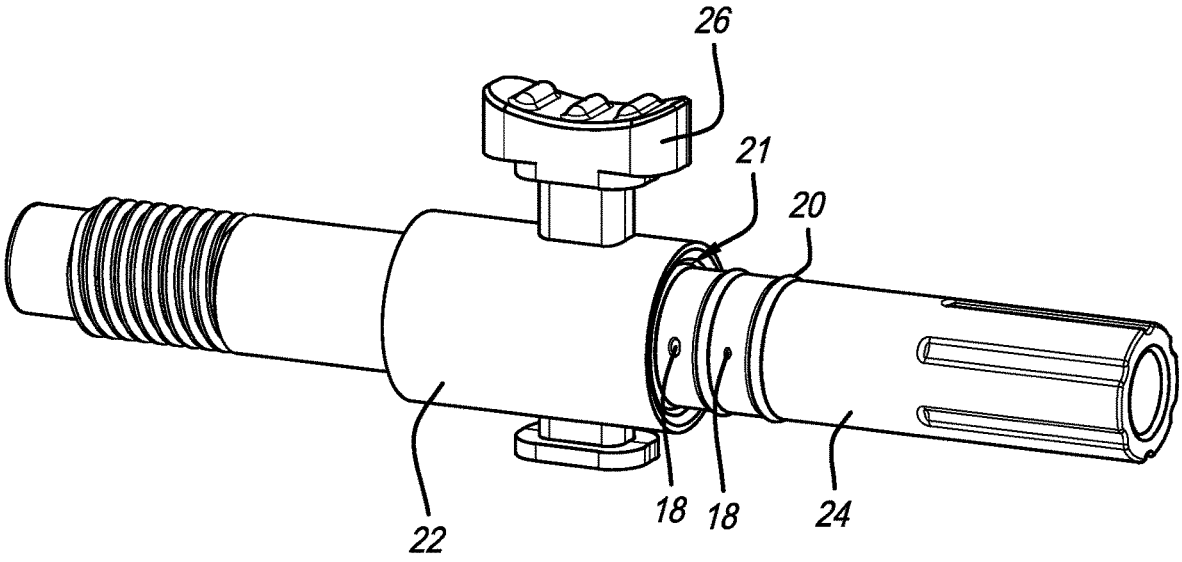
FIG. 3 is a perspective of the variable velocity barrel assembly.
Figure 4:
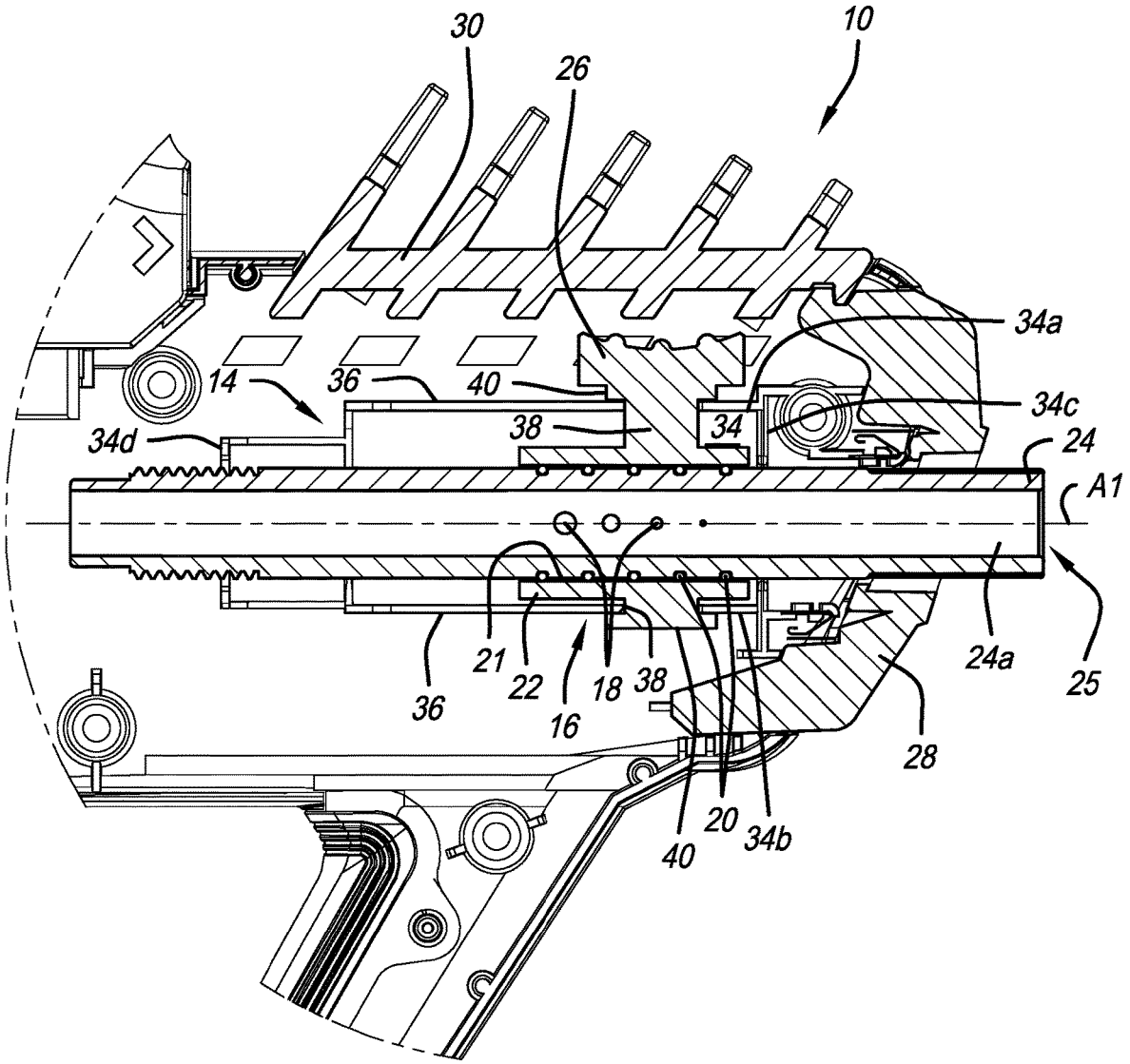
FIG. 4 is a side cross-sectional view of the blaster of FIG. 1.

FIGS. 2-6 show a variable velocity barrel assembly 14 that includes a barrel 24, a slider member 16, a plurality of openings 18 and a plurality of seal members 20 (e.g., o-rings) interspersed between (before and after) the pairs of openings 18. The slider member 16 includes a cylindrical portion 22 that surrounds and is movable along the barrel 24 and a handle portion 26 that a user can interact with, grasp or otherwise contact to move the slider member 16, and the cylindrical portion 22 thereof, axially along the barrel 24. The slider member 16 is long enough that it can cover all of the openings 18, as shown in FIG. 4. The cylindrical portion 22 includes a central opening 21 through which the barrel 24 extends. The barrel 24 defines a barrel axis A1 and a barrel interior 24*a* and includes an exit opening 25 at a distal end thereof.

It will be appreciated that, in use, as the projectile is fired through and travels down the barrel 24, there is a point or section within the barrel 24 where the projectile reaches its maximum velocity. The barrel 24 and barrel interior includes a velocity portion 23, section or distance along the barrel through which the projectile reaches this maximum velocity. The velocity portion 23 is part of the variable velocity barrel assembly 14. The velocity portion 23 includes the openings 18 that are defined through the barrel (communicating the barrel interior with the barrel exterior). The opening 18 can be any shape. FIGS. 3-4 show round openings. However, the openings can be elongated (i.e., slots) or other shape. Furthermore, the openings 18 can be different sizes (see FIG. 4) to vent more or less air, thereby helping to fine tune the different pressure release for each position of the cylindrical portion 22 of the slider member 16, and therefore, the different velocity or speed.

It will be appreciated that the more openings 18 that are exposed, the more pressure that is released, thus slowing the velocity or speed of the fired projectile. During use or firing of a projectile, pressurized gas that is pushing the projectile through the barrel is released or vented through the openings 18 (creating a muzzle break), thereby releasing pressure and limiting the velocity of the fired projectile as it exits the barrel 24. The slider member 16 is slideable between a maximum velocity position (where all openings 18 are covered) and a minimum velocity position (where all openings 18 are exposed) and one or more intermediate velocity positions, where the velocity increases as more openings 18 are covered by the cylindrical portion. The positions are each user selectable. The seal members 20 create a seal with the inner surface of the cylindrical portion 22 to prevent gas from escaping through the covered openings 18 (openings or sets of openings that are positioned between seal members).

FIG. 2 shows a partial side view of the first blaster 10 with a portion of the housing 28 removed to show the housing interior 28*a*, the variable velocity barrel assembly 14 therein and with the slider member 16 in the minimum velocity position with none of the openings covered. FIG. 3 shows the variable velocity barrel assembly 14 with the barrel 24, slider member 16 and two sets of openings 18 exposed (an intermediate velocity position). In the exemplary variable velocity barrel assembly 14, the barrel 24 includes four sets of opposing openings. This provides five different positions that the slide member 16 can take. The positions of the slider member 16 may be referred to as a maximum velocity or first position (where all openings are covered—maximum pressure and velocity), as shown in FIG. 4, a first intermediate or second position (where three of four openings are covered—reduced pressure and velocity compared to the first position), a second intermediate or third position (where two of four openings are covered—reduced pressure and velocity compared to the second position), as shown in FIG. 3, a third intermediate or fourth position (where one of four openings are covered—reduced pressure and velocity compared to the third position), and a minimum velocity or fifth position (where zero of four openings are covered—minimum velocity with reduced pressure and velocity compared to the fourth position), as shown in FIG. 2 and so forth.

As shown in FIGS. 2 and 4, for the first blaster 10, the slider member 16 is disposed completely within the housing 28 and must therefore include a way to access the slider member 16 and the handle portion 26 thereof so that a user can move the slider member 16. As shown in FIG. 6, the first blaster 10 includes a removable member 30 that is a fin assembly that is used for aiming. The removable member 30 in the first blaster 10 is a fin assembly, any removable portion that hides or covers the slider member 16 so that it is within the housing, and is then removable to expose and provide access to the slider member 16 is within the scope of the invention. When removed, an access slot 32 that provides access to the housing interior is exposed. As shown in FIG. 6, the handle portion 26 is accessible through the access slot 32 and extends upwardly from the cylindrical portion 22, thus providing the user the ability to manipulate and move the slider member 16.

Figure 5:
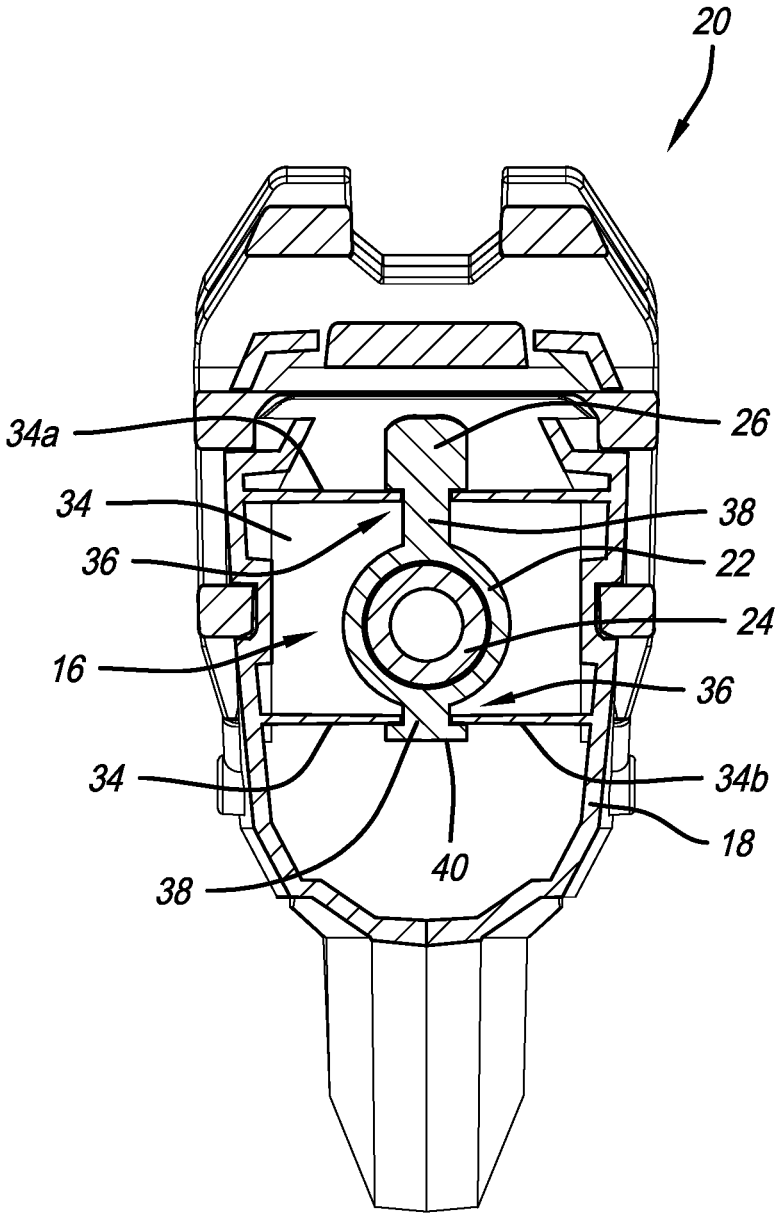
FIG. 5 is a front cross-sectional view of the blaster of FIG. 1.

As shown in FIGS. 4 and 5, the slider member 16 is at least partially contained in and moves along a compartment 34 that is connected to the housing 28 and that includes one or more slots 36 defined therein. The slider member 16 may include first and second or upper and lower extension members 38 that have flanges 40 thereon and that together help guide the slider member 16 forwardly or rearwardly (axially along the barrel). The flanges 40 are wide enough that they do not fit through the slots 36. In another embodiment, the slider member only includes one extension member. The compartment 34 may include an upper wall 34*a*, lower wall 34*b*, front wall 34*c* and rear wall 34*d*. Furthermore, the compartment 34 and the associated slots 36, flanges 40 extension members 38 and other components are preferably sized so that the cylindrical portion 22 can be positioned in the first position at the front end of the compartment and in the fifth position at the rear end of the compartment. The slider member 16 stops at the opposing ends as a result of the slots 36.

Figure 8:
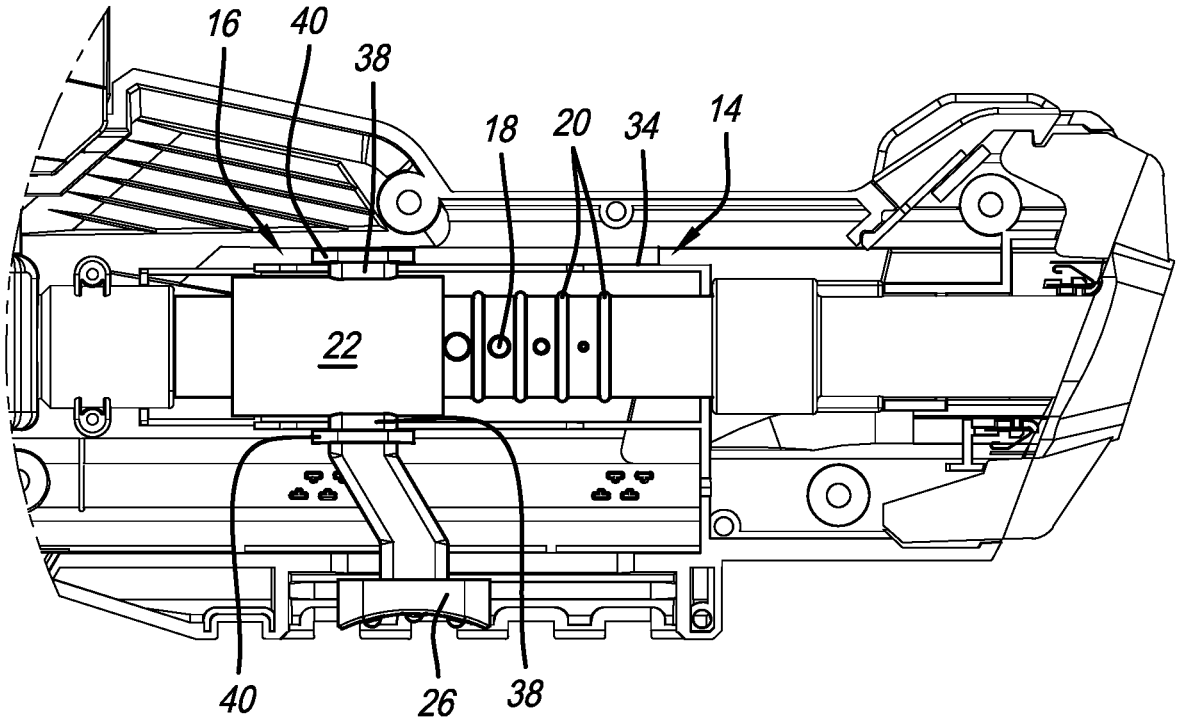
FIG. 8 is a side elevational view of the blaster of FIG. 7 with a portion of the housing removed.
Figure 9:
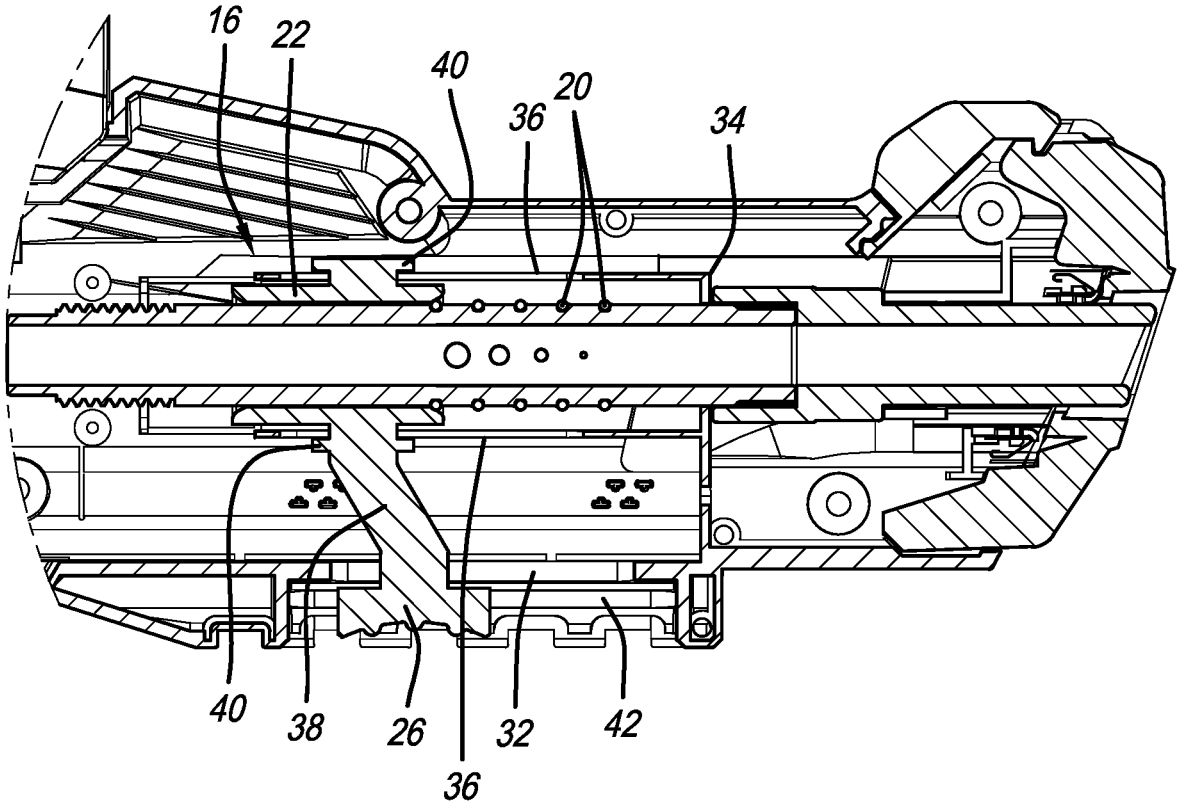
FIG. 9 is a side cross-sectional view of the blaster of FIG. 7.

FIGS. 7-11 show the variable velocity variable assembly or system used for second blaster 12. FIG. 8 shows the variable velocity barrel assembly 14 with the barrel 24 and slider member 16. FIG. 9 shows the slider member and barrel member in cross-section. The figures show four sets or pairs of openings 18 on opposing sides of the barrel 24. However, openings on any of the blasters or barrels may only be included on one side.

Figure 10:
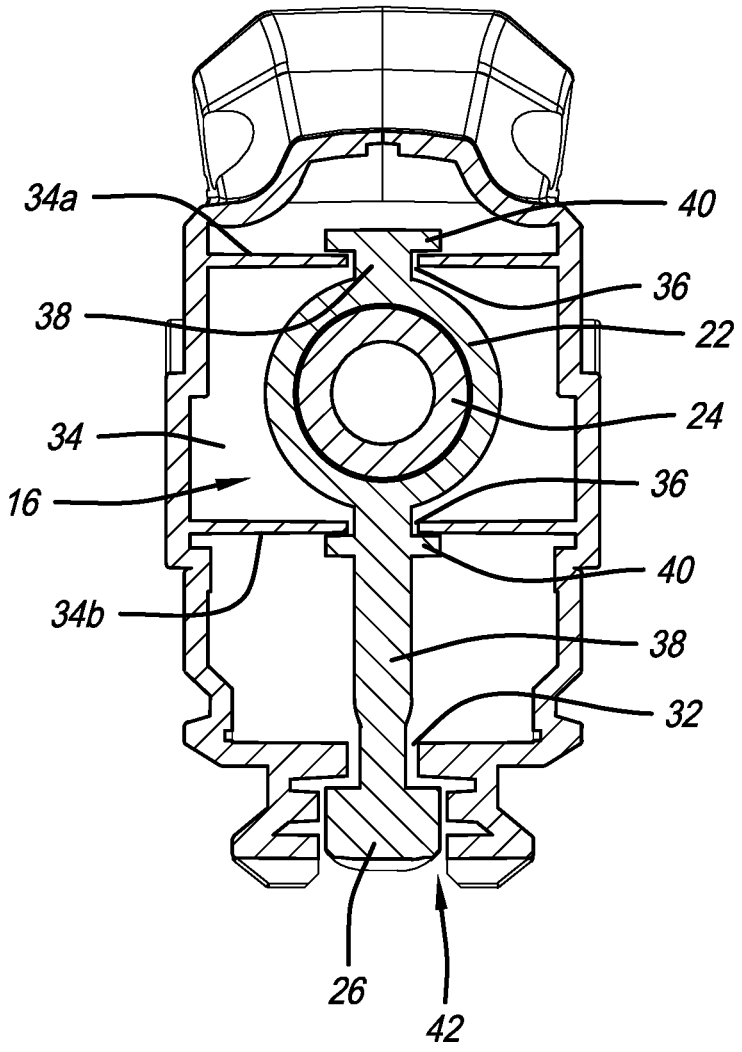
FIG. 10 is a front cross-sectional view of the blaster of FIG. 7.
Figure 11:
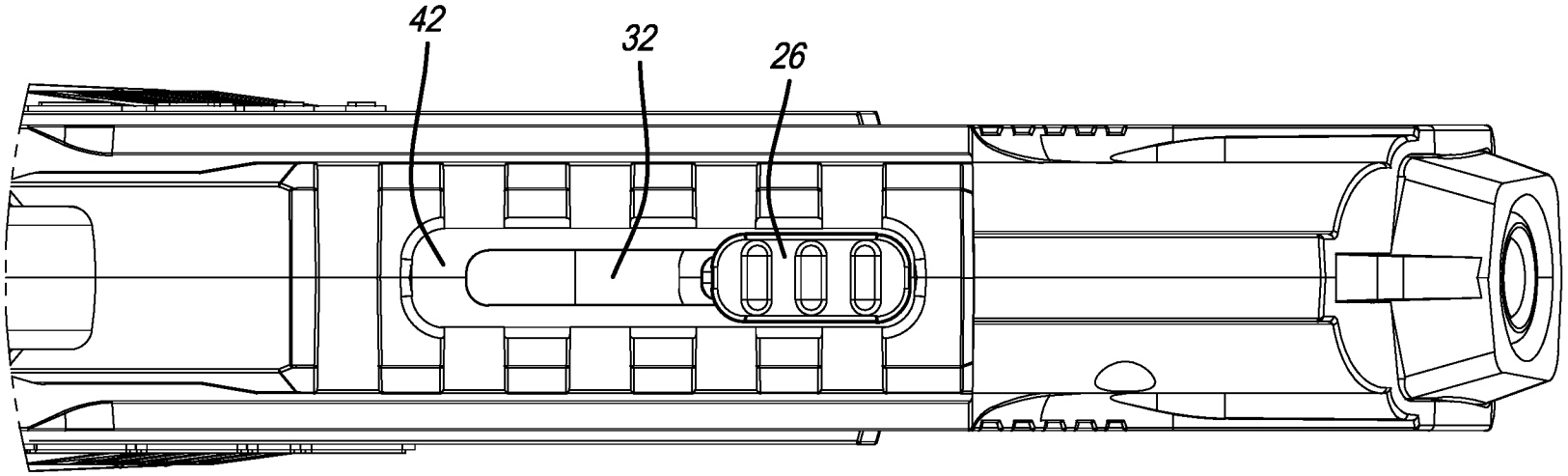
FIG. 11 is a bottom view of the blaster of FIG. 7.

As shown in FIG. 10, the slider member 16 is at least partially contained in and moves along a compartment 34 that is connected to the housing 28 and that includes one or more slots 36 defined therein. The slider member 16 may include upper and lower extension members 38 that have flanges 40 thereon and that together help guide the slider member 16 forwardly or rearwardly (axially along the barrel).

As shown in FIGS. 8-11 the extension member 38 may extend downwardly and include the handle portion 26 on the end thereof. The extension member 38 extends through an access slot 32 and the handle portion 26 preferably is secured in and is movable with a trough 42 in the housing 28, so that it is accessible from outside the housing, thus providing the user the ability to manipulate and move the slider member 16. The extension member 38 may also include a flange 40 at an intermediate location, just outside of the compartment 34 or just below lower wall 34*b*, as shown in FIG. 10.

In another embodiment, the slider member can include a lever for moving the slider member axially. In another embodiment, the slider member can include an arm extending therefrom that can be movable into vertically oriented slots or detents to keep the slider member in the proper position. The extension members can also extend sideways or sidewardly to provide access to the handle portion on a side of the barrel portion of the housing.

The present invention also includes the method of varying the velocity by moving the slider member 16 axially along the barrel to cover or uncover or expose or seal off one or more openings or sets of openings. This is done by creating a seal with one of the seal members and the inner surface of the cylindrical portion so that air is expelled through the openings that provide fluid communication between the barrel interior and the barrel exterior, if any. The method may also include removing the removable member to access the handle portion and then placing the removable member back into position.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

Although the operations of any method(s) disclosed or described herein either explicitly or implicitly are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The teachings of the disclosure provided herein can be applied to other systems, not necessarily the system described above. The elements and acts of the various embodiments described above can be combined to provide further embodiments. Any measurements or dimensions described or used herein are merely exemplary and not a limitation on the present invention. Other measurements or dimensions are within the scope of the invention.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112, ¶6, other aspects may likewise be embodied as a means-plus-function claim, or in other forms, such as being embodied in a computer-readable medium. (Any claims intended to be treated under 35 U.S.C. § 112, ¶6 will include the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A blaster for shooting projectiles, the blaster comprising:

a housing that defines a housing interior, a variable velocity barrel assembly positioned in the housing interior, wherein the variable velocity barrel assembly includes a barrel that defines a barrel axis and a barrel interior, and wherein the barrel includes an exit opening at a distal end thereof, a first opening communicating the barrel interior with an exterior of the barrel, wherein the first opening is defined through a side wall of the barrel, a second opening defined through the side wall of the barrel, a slider member that includes a cover portion, wherein the slider member is movable with respect to the barrel between a maximum velocity position where the cover portion covers the first and second openings, an intermediate velocity position where the cover portion covers the first opening, and a minimum velocity position where the cover portion does not cover either of the first or second openings.

2. The blaster of claim 1 wherein a seal member is disposed between the first opening and the second opening.

3. A blaster for shooting projectiles, the blaster comprising:

a housing that defines a housing interior, a variable velocity barrel assembly positioned in the housing interior, wherein the variable velocity barrel assembly includes a barrel that defines a barrel axis and a barrel interior, and wherein the barrel includes an exit opening at a distal end thereof, at least a first opening communicating the barrel interior with an exterior of the barrel, wherein the first opening is defined through a side wall of the barrel, a slider member that includes a cover portion, wherein the slider member is movable with respect to the barrel between a maximum velocity position where the cover portion covers the first opening and a minimum velocity position where the cover portion does not cover the first opening, wherein a first extension member extends outwardly from the cover portion, wherein a handle portion is positioned at a distal end of the extension member.

4. The blaster of claim 3 wherein the housing includes an access slot defined therein that provides access to the slider member.

5. The blaster of claim 4 wherein the access slot is covered by a removable member, wherein removing the removable member exposes the access slot and allows access to the slider member that is positioned in the housing interior.

6. The blaster of claim 3 wherein the compartment includes an upper wall and a lower wall, wherein the first slot is defined in the upper wall and a second slot is defined in the lower wall, wherein a second extension member extends downwardly from the cover portion and through the second slot, wherein a flange is positioned on an end of the second extension member.

7. The blaster of claim 3 wherein the compartment includes an upper wall and a lower wall, wherein the first slot is defined in the lower wall, wherein the first extension member extends through an access slot defined in the housing and includes a handle portion an a distal end thereof, wherein the handle portion is positioned exterior of the housing.

8. The blaster of claim 3 wherein the housing includes a trough defined therein, wherein the handle portion is slideable within the trough.

9. The blaster of claim 1 wherein the second opening is positioned closer to the distal end of the barrel than the first opening.

10. The blaster of claim 3 wherein the barrel includes a second opening communicating the barrel interior with an exterior of the barrel, wherein the second opening is defined through a side wall of the barrel, wherein the second opening is positioned closer to the distal end of the barrel than the first opening.

11. The blaster of claim 1 wherein the first opening and the second opening have different dimensions.

12. The blaster of claim 3 wherein the barrel includes a second opening communicating the barrel interior with an exterior of the barrel, wherein the second opening is defined through a side wall of the barrel, wherein the slider member is movable with respect to the barrel between the maximum velocity position where the cover portion covers the first and second openings, the minimum velocity position where the cover portion does not cover the first opening, and an intermediate velocity position where the cover portion does not cover the second opening.

13. A blaster for shooting projectiles, the blaster comprising:

a housing that defines a housing interior, a variable velocity barrel assembly positioned in the housing interior, wherein the variable velocity barrel assembly includes a barrel that defines a barrel axis and a barrel interior, wherein the barrel includes an exit opening at a distal end thereof, a first opening communicating the barrel interior with an exterior of the barrel, wherein the first opening is defined through a side wall of the barrel, a slider member that is movable with respect to the barrel, wherein the slider member is movable between a first position where a first volume of air is vented from the barrel interior to the barrel exterior when a first projectile is shot from the barrel, and a second position where a second volume of air is vented from the barrel interior to the barrel exterior when a second projectile is shot from the barrel, and wherein the first volume is different than the second volume.

14. The blaster of claim 13 wherein the slider member is movable to a third position where no air is vented from the barrel interior to the barrel exterior when a third projectile is shot from the barrel.

15. The blaster of claim 13 wherein the barrel includes a second opening communicating the barrel interior with an exterior of the barrel, wherein the second opening is defined through a side wall of the barrel, wherein the first opening and the second opening have different dimensions.

16. The blaster of claim 13 wherein the slider member includes a handle portion that is accessible from an exterior of the housing, whereby the slider member is configured to be moved between the first and second positions via the handle portion.

17. The blaster of claim 13 wherein the barrel includes a second opening communicating the barrel interior with an exterior of the barrel, wherein the second opening is defined through a side wall of the barrel, wherein the first opening and the second opening have different dimensions, and wherein the slider member is movable to a third position where no air is vented from the barrel interior to the barrel exterior when a third projectile is shot from the barrel.

18. A method of using a blaster that shoots projectiles, wherein the blaster includes a barrel with an exit opening at a distal end of the barrel, and a slider member that is movable with respect to the barrel, the method comprising the steps of:

positioning the slider member at a first position and shooting a first projectile through the exit opening at a first speed, moving the slider member to a second position and shooting a second projectile through the exit opening at a second speed, and moving the slider member to a third position and shooting a third projectile through the exit opening at a third speed.

19. The method of claim 18 wherein a first volume of air is vented through a sidewall of the barrel from a barrel interior to a barrel exterior when the first projectile is shot, wherein a second volume of air is vented through the sidewall of the barrel from the barrel interior to the barrel exterior when the second projectile is shot, and wherein the first volume is different than the second volume.

20. The method of claim 18 wherein the blaster further comprises a housing that defines a housing interior, wherein at least a portion of the barrel is positioned in the housing interior, wherein the slider member includes a handle portion that is accessible from an exterior of the housing, whereby the slider member is configured to be moved between the first, second and third positions via the handle portion.

* * * * *